US008233828B2

(12) United States Patent
Shigeta et al.

(10) Patent No.: US 8,233,828 B2
(45) Date of Patent: Jul. 31, 2012

(54) DEVELOPING APPARATUS, IMAGING UNIT, AND IMAGE FORMING APPARATUS INCLUDING DEVELOPER MIXING CONTAINER WITH AUXILIARY MEMBER TO CIRCULATE DEVELOPER

(75) Inventors: Kunio Shigeta, Yokohama (JP); Naoya Iwata, Yokohama (JP)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 372 days.

(21) Appl. No.: 12/565,028

(22) Filed: Sep. 23, 2009

(65) Prior Publication Data

US 2010/0129117 A1 May 27, 2010

(30) Foreign Application Priority Data

Nov. 25, 2008 (JP) ..... 2008-299712
May 1, 2009 (KR) ..... 2009-38736

(51) Int. Cl.
*G03G 15/08* (2006.01)

(52) U.S. Cl. ..... 399/254

(58) Field of Classification Search ..... 399/254
See application file for complete search history.

(56) References Cited

U.S. PATENT DOCUMENTS

2006/0029431 A1 * 2/2006 Tanaka et al. ..... 399/254

FOREIGN PATENT DOCUMENTS

JP 2003-114576 4/2003

* cited by examiner

*Primary Examiner* — Quana M Grainger
(74) *Attorney, Agent, or Firm* — Stanzione & Kim, LLP

(57) ABSTRACT

A developing apparatus includes a first rotation member having a rotation shaft to transfer developer in a first direction and a mixing and transfer member having a spiral wing shape to mix and transfer the developer to the center portion of the rotation shaft, a second rotation member having a rotation shaft including a mixing and transfer member to transfer the developer in a direction opposite to the first direction by the first rotation member and a circulation auxiliary member to transfer the developer to the center portion of the rotation shaft, two end portion partition walls formed along the circulation auxiliary member, and a center partition wall formed along the mixing and transfer member at a position separated from the end portion partitions wall.

18 Claims, 9 Drawing Sheets

| | DIMENSION (mm) | SPIRAL PITCH (mm) |
|---|---|---|
| a | 10 | 5 |
| b | 325 | 25 |
| c | 8 | — |
| d | 10 | 5 |
| e | 50 | 12.5 |
| f | 325 | 25 |
| g | 8 | — |
| h | 10 | 5 |
| j | 11 | — |
| k | 30 | — |
| m | 30 | — |
| n | 11 | — |

| | DIMENSION(mm) |
|---|---|
| p | 18 |
| q | 18 |
| r | 1.5 |
| s | 1.5 |
| t | 23 |

| | DIMENSION(mm) |
|---|---|
| p | 18 |
| q | 18 |
| r | 1.0 |
| s | 1.0 |
| t | 23 |

DEVELOPING APPARATUS, IMAGING UNIT, AND IMAGE FORMING APPARATUS INCLUDING DEVELOPER MIXING CONTAINER WITH AUXILIARY MEMBER TO CIRCULATE DEVELOPER

CROSS-REFERENCE TO RELATED APPLICATIONS

This application claims the benefit of Japanese Patent Application No. 2008-299712, filed on Nov. 25, 2008, in the Japanese Patent Office, and Korean Patent Application No. 10-2009-0038736, filed on May 1, 2009, in the Korean Intellectual Property Office, the disclosures of which are incorporated herein in their entirety by reference.

BACKGROUND

1. Field of the Invention

The present general inventive concept relates to a developing apparatus, an imaging unit, and an image forming apparatus.

2. Description of the Related Art

An electrophotographic image forming apparatus forms an image by forming an electrostatic latent image on an outer circumferential surface of a photosensitive drum that is uniformly charged and visualizing the electrostatic latent image using toner. The electrophotographic image forming apparatus is used for digital type printers or copiers. For example, a binary developer formed of toner and carrier is used for the image forming apparatus. A toner image is formed by adhering the toner, that is frictionally charged by a mixing unit installed in the developing apparatus, to the electrostatic latent image formed on the outer circumferential surface of the photosensitive drum.

The developing apparatus of the image forming apparatus configured as above generally includes a plurality of developer transfer member that mixes and transfers the developer formed of toner and carrier in a development container to which the toner is supplied. The developer transfer member is provided with a spiral wing member at a rotation shaft to mix and transfer the developer. Also, both end portions of the rotation shaft of the developer transfer member are rotatably supported on the development container via a bearing portion.

When the developer intrudes into the bearing portion as the developer transfer member circulates the developer in the development container, torque of the bearing portion increase so that the bearing portion may be overheated. As a result, the toner is melted and closely contacts the bearing portion or granulated in the vicinity of the bearing portion. Accordingly, the bearing portion is locked so as not to be able to form an image. Also, the generated granulates are accumulated on a layer restriction portion to generate a vertical line on an image. Furthermore, a defect such as a spot is generated on an image so that reliability/durability of the developing apparatus may be deteriorated

SUMMARY

The present general inventive concept provides a developing apparatus which can maintain durability of the bearing portion and can simultaneously supply a developer to the whole axial direction of a developing roller (or a developer holding member), without increasing the size of the developing apparatus. The present general inventive concept can also provide an imaging unit and an image forming apparatus having the same.

Additional embodiments of the present general inventive concept will be set forth in part in the description which follows and, in part, will be obvious from the description, or may be learned by practice of the general inventive concept.

Embodiments of the present general inventive concept can be achieved by providing a developing apparatus including a developer mixing container in which a developer circulation path along which developer including toner and carrier are mixed and circulated is formed, and a developer holding member to hold the developer mixed on the developer circulation path, the developer mixing container including a first rotation member to supply the developer to the developer holding member and comprising a rotation shaft extending in the same direction as a rotation shaft direction of the developer holding member, a mixing and transfer member having a spiral wing shape on a corresponding rotation shaft to mix and transfer the developer to any one of a lengthwise directions of the rotation shaft, and a circulation auxiliary member having a spiral wing shape formed in a section on a corresponding rotation shaft to transfer the developer to a center portion of the rotation shaft from a downstream side in a developer transfer direction, a second rotation member comprising a rotation shaft extending in the same direction as a rotation shaft direction of the first rotation member and parallel to the first rotation member, a mixing and transfer member having a spiral wing shape on a corresponding rotation shaft to transfer the developer in a direction opposite to the developer transfer direction by the first rotation member, and a circulation auxiliary member having a spiral wing shape formed in a section on a corresponding rotation shaft to transfer the developer to a center portion of the rotation shaft from a downstream side in the developer transfer direction; two end portion partition walls extending from an inner wall of the developer mixing container along the circulation auxiliary member between the first and second rotation members, and a center partition wall formed in a section along the mixing and transfer member at a position separated from the end portion partitions wall between the first and second rotation members, wherein a spiral pitch of the circulation auxiliary member is ¼-½ of an outer diameter of the circulation auxiliary member, a section in which the circulation auxiliary member is formed is 1.5-3 of the spiral pitch of the circulation auxiliary member, a connection portion through which the developer is circulated is formed as the end portion partition walls and the center partition wall are separated from each other by 1-1.5 times of the spiral pitch of the mixing and transfer member, and wherein the mixing and transfer member formed on each of the first and second rotation members extends to the downstream side in the developer transfer direction farther than at least a center portion of each of the first and second connection portions.

Example embodiments of the present general inventive concept can also be achieved by providing a developing apparatus to mix and circulate the developer using a mixing and transfer member formed on each of the first and second rotation members. Also, the developer intruding into the bearing portion of the rotation shaft may be transferred back to the central portion of the rotation shaft by the circulation auxiliary member so that durability of the bearing may be improved. Also, the end portion partition wall can prevent the intrusion of the developer into the bearing portion in a direction perpendicular to the axial direction. Also, the interval section between the circulation auxiliary member and the mixing and transfer member can be formed at the downstream of the developer rather than at the center portion of the connection portion of the circulation path. As a result, the developer may be efficiently circulated over the entire portion of the connection portion and the developer may be certainly supplied to the end portion of the developer holding member.

Clearance between the developer mixing container and each of the first and second rotation members at positions where the end portion partition walls are formed may be smaller than that between the developer mixing container and each of the first and second rotation members at positions where the center partition wall is formed.

Example embodiments of the present general inventive concept can also reduce the clearance between the circulation auxiliary member and the end portion partition wall or the developer mixing container to improve the efficiency of circulation of developer back to the center portion of the rotation shaft by the circulation auxiliary member and to inhibit the intrusion of developer into the bearing portion.

The circulation auxiliary member may be separated from the mixing and transfer member by 1-2 times of the spiral pitch of the circulation auxiliary member. The section where the circulation auxiliary member is formed may be 2-2.5 times of the spiral pitch of the circulation auxiliary member. Accordingly, without increasing the size of the developing apparatus, the efficiency of transferring the developer back to the center portion of the rotation shaft by the circulation auxiliary member may be improved and the intrusion of the developer into the bearing portion may be prevented.

Example embodiments of the present general inventive concept can also be achieved by providing an imaging unit including an image holding member in which an electrostatic latent image is formed on a circumferential surface thereof. The imaging unit can also include a developing apparatus to adhere toner to the electrostatic latent image formed on the circumferential surface of the image holding member, and a cleaning apparatus to remove the toner remaining on the circumferential surface of the image holding member, wherein the developing apparatus includes a developer mixing container in which a developer circulation path along which developer including toner and carrier are mixed and circulated is formed, and a developer holding member to hold the developer mixed on the developer circulation path, the developer mixing container including a first rotation member rotatably coupled to a first bearing portion at a first end of the mixing container and to a second bearing portion at a second end of the mixing container and having a first mixing and transfer member to circulate developer in a first direction from the first bearing portion to the second bearing portion and a first auxiliary member proximate the second bearing portion to circulate the developer away from the second bearing portion in a second direction opposite the first direction, and a second rotation member rotatably coupled to a third bearing portion at the first end of the mixing container and to a fourth bearing portion at the second end of the mixing container and having a second mixing and transfer member to circulate developer in the second direction and a second auxiliary member proximate the third bearing portion to circulate developer away from the third bearing portion in the first direction.

The developer mixing container can further include two end portion partition walls extending from an inner wall of the developer mixing container between the first and second rotation members, and a center partition wall formed in a section along the mixing and transfer members at a position separated from the end portion partition walls between the first and second rotation members to define first and second openings between the first and second rotation members.

The mixing and transfer members formed on each of the first and second rotation members can extend along the first and second rotation members beyond at least a center portion of the first and second openings.

Example embodiments of the present general inventive concept can also be achieved by providing an image forming apparatus including a detachable imaging unit as described above to form an image on a recording medium.

Example embodiments of the present general inventive concept can supply the developer over the entire portion of the developing roller (the developer holding member) without increasing the size of the developing apparatus and while maintaining the durability of the bearing portion.

Example embodiments of the present general inventive concept can also be achieved by providing a mixing container to mix developer of an image forming unit, including a first rotation member rotatably coupled to a first bearing portion at a first end of the mixing container and to a second bearing portion at a second end of the mixing container to circulate developer in a first direction from the first bearing portion to the second bearing portion, and a first auxiliary member coupled to the first rotation member proximate the second bearing portion to circulate the developer away from the second bearing portion in a second direction opposite the first direction.

The mixing container can further include a second rotation member rotatably coupled to a third bearing portion at the first end of the mixing container and to a fourth bearing portion at the second end of the mixing container to circulate developer in the second direction, and a second auxiliary member coupled to the second rotation member proximate the third bearing portion to circulate developer away from the third bearing portion in the first direction.

The mixing container can further include a partition wall disposed between the first and second rotation members to define first and second circulation portions of the mixing container, respectively, and having a first opening proximate the first and third bearing portions and a second opening proximate the second and fourth bearing portions to communicate the developer between the first and second circulation portions.

The mixing container can further include a supply portion to supply developer to the second circulation portion, and a developing roller mounted adjacent the first rotation member and between the first and second auxiliary members to receive the developer from the first circulation portion.

Example embodiments of the present general inventive concept can also be achieved by providing an image forming apparatus having a developing device to form an image on a recording medium, the developing device including a mixing container to supply developer to the developing device as defined above.

BRIEF DESCRIPTION OF THE DRAWINGS

The above and other embodiments of the present general inventive concept will become apparent and more readily appreciated from the following description of the example embodiments, taken in conjunction with the accompanying drawings of which.

DETAILED DESCRIPTION OF THE EMBODIMENTS

Figure 1:
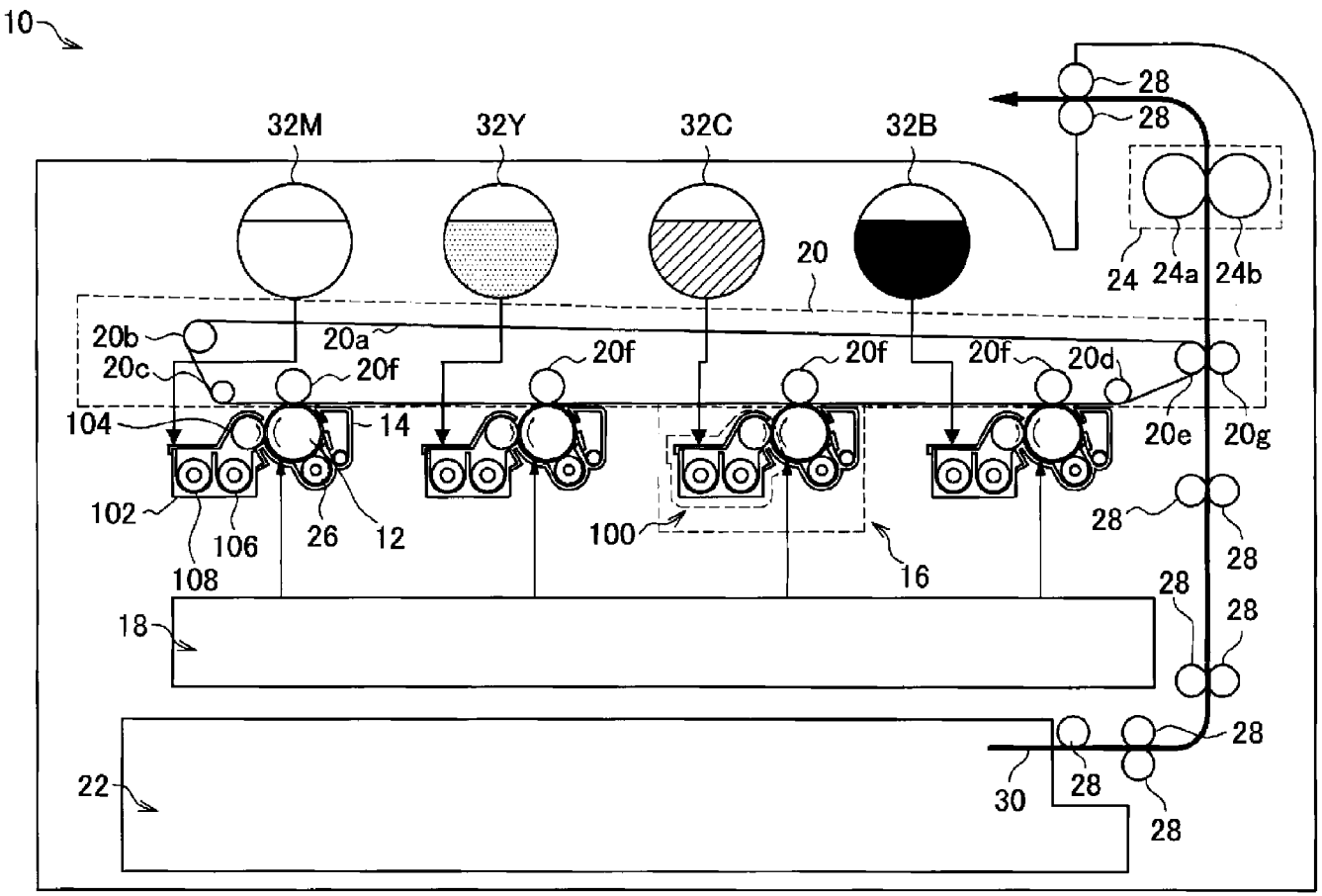
FIG. 1 illustrates the structure of a tandem type image forming apparatus including a developing apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The overall structure of an image forming apparatus 10 having a developing apparatus 100 according to an embodiment of the present general inventive concept will be described with reference to the drawings. FIG. 1 illustrates the structure of a tandem type image forming apparatus 10 including the developing apparatus 100 according to an embodiment of the present general inventive concept.

Referring to FIG. 1, the image forming apparatus 10 can include a plurality of imaging units 16 having the developing apparatus 100 and a photosensitive drum 12, a light scanning unit 18, an intermediate transfer portion 20, a recording medium transfer unit 22, a fixing unit 24.

The developing apparatus 100 can be installed for each of magenta, yellow, cyan, and black colors, for example, and can include a developing roller 104 (or a developer holding member 104), a developer mixing container 102, a developer supply member 106, and a developer mixing and transfer member 108. The developer supply member 106 and the developer mixing and transfer member 108 can be installed in the developer mixing container 102. The structure of the developing apparatus 100 will be described in more detail below.

Each of the image units 16 can include the developing apparatus 100, the photosensitive drum 12, a charger 26 to uniformly charge the outer circumferential surface of the photosensitive drum 12 to a negative charge, and a cleaning unit 14 to remove toner adhering to the outer circumferential surface of the photosensitive drum 12. Also, the light scanning unit 18 can scan laser light onto the outer circumferential surface of the photosensitive drum 12 that is uniformly charged, for exposure, to form an electrostatic latent image on the photosensitive drum 12 according to an image signal of an image to be recorded.

The intermediate transfer portion 20 can include a transfer belt 20*a* having an endless shape and circulated by a drive roller 20*b*, a tension roller 20*c*, and support rollers 20*d* and 20*e*, which can be arranged along the inner circumferential side of the transfer belt 20*a*, a plurality of first transfer rollers 20*f*, and a second transfer roller 20*g*. The first transfer rollers 20*f* can be installed at the inner circumferential side of the transfer belt 20*a* to press the transfer belt 20*a* from the outer circumferential surface of the photosensitive drum 12. Also, the second transfer roller 20*g* can be installed at the opposite side to the support roller 20*e* with respect to the transfer belt 20*a*. Although it is not illustrated in FIG. 1, the intermediate transfer portion 20 may further include a belt cleaning unit to remove the toner adhering to the transfer belt 20*a*.

The recording medium transfer unit 22 can include a plurality of transfer rollers 28 to rotate in synchronism with a cassette (not illustrated) to accommodate a plurality of sheets of a recording medium 30. The recording medium transfer unit 22 can take the recording medium 30 out of the cassette and can transfer the recording medium 30 between the second transfer roller 20*g* and the transfer belt 20*a*. Also, the recording medium transfer unit 22 can transfer the recording medium 30 holding a toner image by the second transfer roller 20*g*, to the fixing unit 24, and can further transfer the recording medium 20 on which the toner image is fixed, thereby exhausting the recording medium 20 out of the image forming apparatus 10.

The fixing unit 24 can include a heat roller 24*a* and a press roller 24*b* which can be installed such that the outer circumferential surfaces of the heat roller 24*a* and the press roller 24*b* may contact and press each other. The heat roller 24*a* can have an approximately cylindrical shape and can be capable of axially rotating. For example, in the heat roller 24*a*, a heat-resistant elastic layer such as silicon rubber can be wound around a metal core member. A heat source such as a halogen lamp may be provided in the heat roller 24*a*. Also, the press roller 24*b* can have an approximately circumferential shape and can be capable of axially rotating. For example, in the press roller 24*b*, a heat-resistant elastic layer such as silicon rubber can be wound around a metal core member. The fixing unit 24 can melt and fix the toner image to the recording medium 30 transferred between the heat roller 24*a* and the press roller 24*b*.

In the operation of the image forming apparatus 10 configured as above to form an image on the recording medium 30, an image signal of an image to be recorded can be transmitted to a control unit (not illustrated) when the image forming apparatus 10 is operated. Then, according to an instruction of the control unit, the charger 26 can uniformly charge the outer circumferential surface of the photosensitive drum 12 to a negative charge. Also, the light scanning unit 18 can emit laser light to the outer circumferential surface of the photosensitive drum 12 so that an electrostatic latent image may be formed according to the image signal.

In the developer mixing container 2 of the developing apparatus 100, a developer mixed by the developer supply member 106 and the developer mixing and transfer member 108 can be supplied to the outer circumferential surface of the developing roller 104. The carrier of a positive charge in the developer held by the developing roller 104 can be kept on the developing roller 104. Only the toner of a negative charge adhering to the carrier is supplied to the electrostatic latent image formed on the outer circumferential surface of the photosensitive drum 12, thereby forming a toner image. Accordingly, the toner image can be formed on the photosensitive drum 12 of each of the imaging units 16 installed for respective colors.

Also, according to the instruction of the control unit, the transfer belt 20*a* of the intermediate transfer portion 20 can be transferred as the drive roller 20*b* is driven. The transferred transfer belt 20*a* can be pressed by the first transfer roller 20*f* against the photosensitive drum 12 of one of the imaging units 16 corresponding to a magenta toner container 32M. A toner image of magenta can be transferred to the outer circumferential surface of the transfer belt 20*a*. Accordingly, as the transfer belt 20*a* sequentially passes the other imaging units 16, toner images of magenta, yellow, cyan, and black can be overlapped with one another on the transfer belt 20*a*.

The recording medium 30 can be transferred between the second transfer roller 20*g* and the transfer belt 20*a* by the recording medium transfer unit 22 according to an operation instruction of the control unit. A color toner image held by the transfer belt 20*a* can be transferred to the recording medium 30. The recording medium 30 to which the second transfer is performed can be transferred to the fixing unit 24 and can pass between the heat roller 24*a* and the press roller 24*b*, with heat and pressure being applied to the recording medium 30, so that the color toner image may be melted and fixed to the recording medium 30. Accordingly, the recording medium 30 on which the image to be recorded is formed can be transferred and exhausted to the outside of the image forming apparatus 10.

Figure 2:
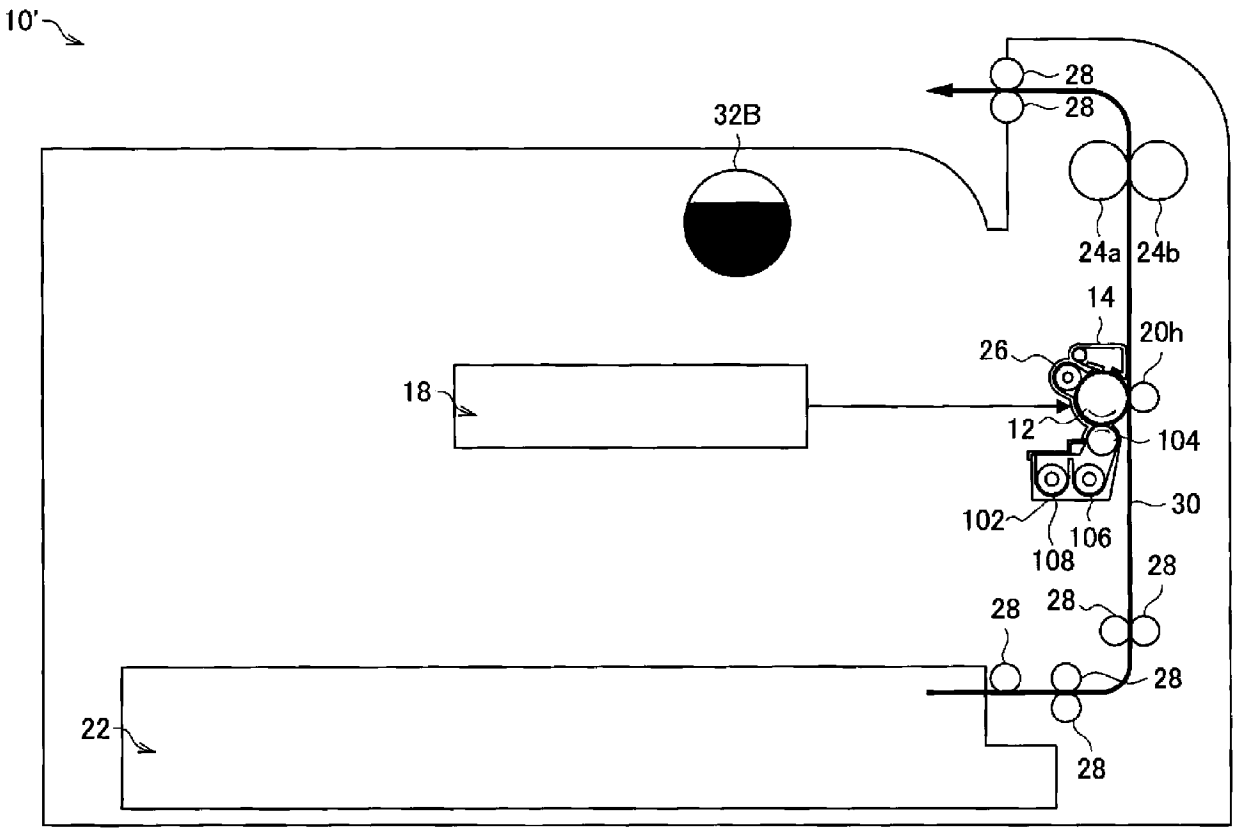
FIG. 2 illustrates the structure of a paper vertical transfer type image forming apparatus including the developing apparatus of FIG. 1.

The tandem type image forming apparatus 10 illustrated in FIG. 1 is an example of an image forming apparatus using the developing apparatus 100 according to an example embodiment of the present general inventive concept. The developing apparatus 100 of the example embodiment may be applied to a variety of types of an image forming apparatus. For example, a paper vertical transfer type image forming apparatus 10' forming a monochrome image as illustrated in FIG. 2 may be used as the image forming apparatus 10. In the image forming apparatus 10' of FIG. 2, the toner image formed on the photosensitive drum 12 can be directly transferred to the recording medium 30 transferred between the photosensitive drum 12 and the transfer roller 20*h*.

Figure 3:
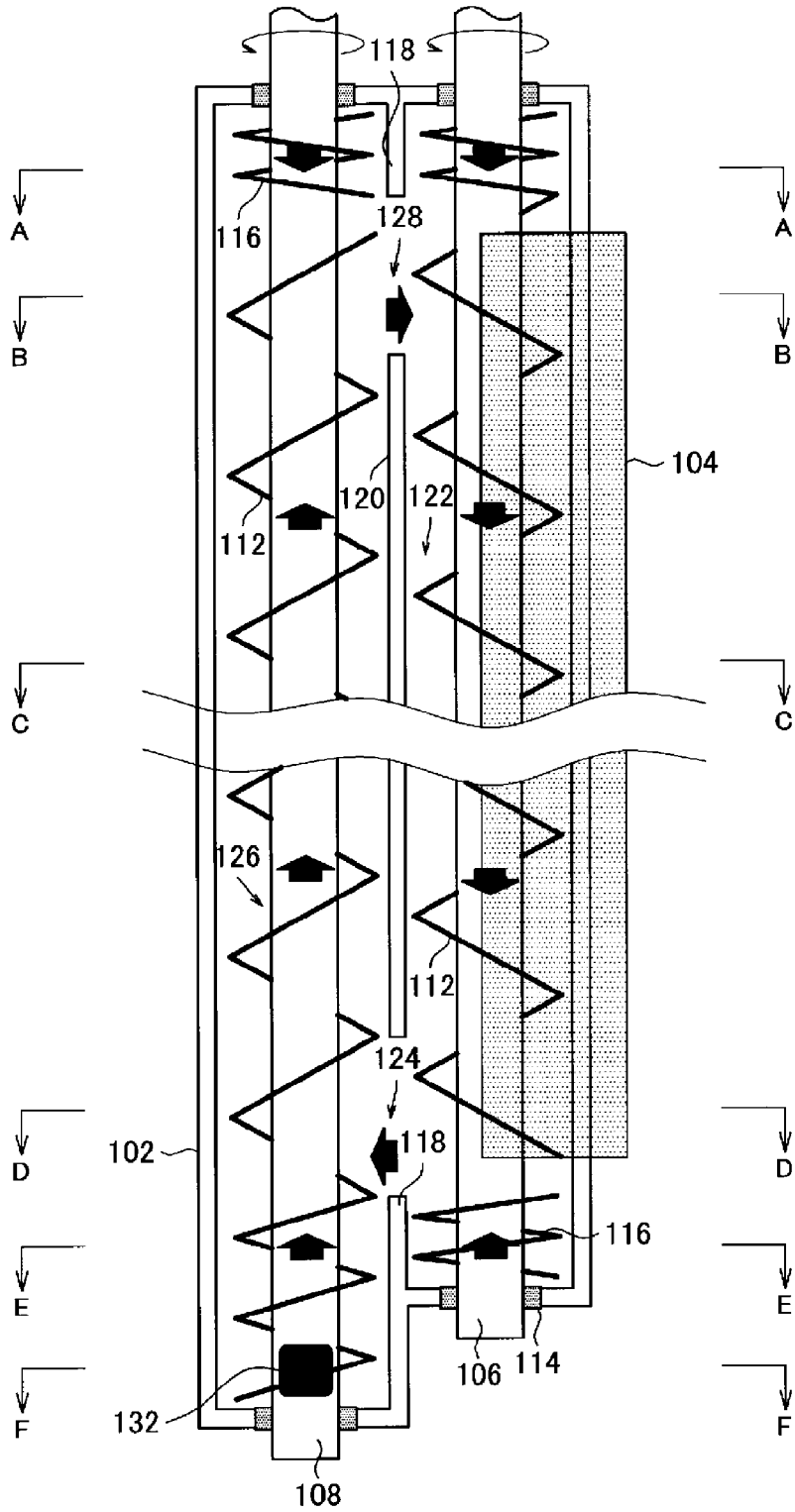
FIG. 3 illustrates the structure of the developing apparatus of FIG. 1.

The structure of the developing apparatus 100 which may be included in the exemplary image forming apparatus 10 will be described below with respect to FIG. 3. FIG. 3 illustrates the structure of the developing apparatus of FIG. 1.

Referring to FIG. 3, the developing apparatus 100 can include the developer mixing container 102 to mix the toner and the carrier supplied from a toner container 32 of FIG. 1 and the above-described developing roller 104. The developer supply member 106 (hereinafter, referred to as the first rotation member 106) that supplies the mixed developer over the whole length of a rotation shaft direction of the developing roller 104 can be installed in the developer mixing container 102.

Figure 4:
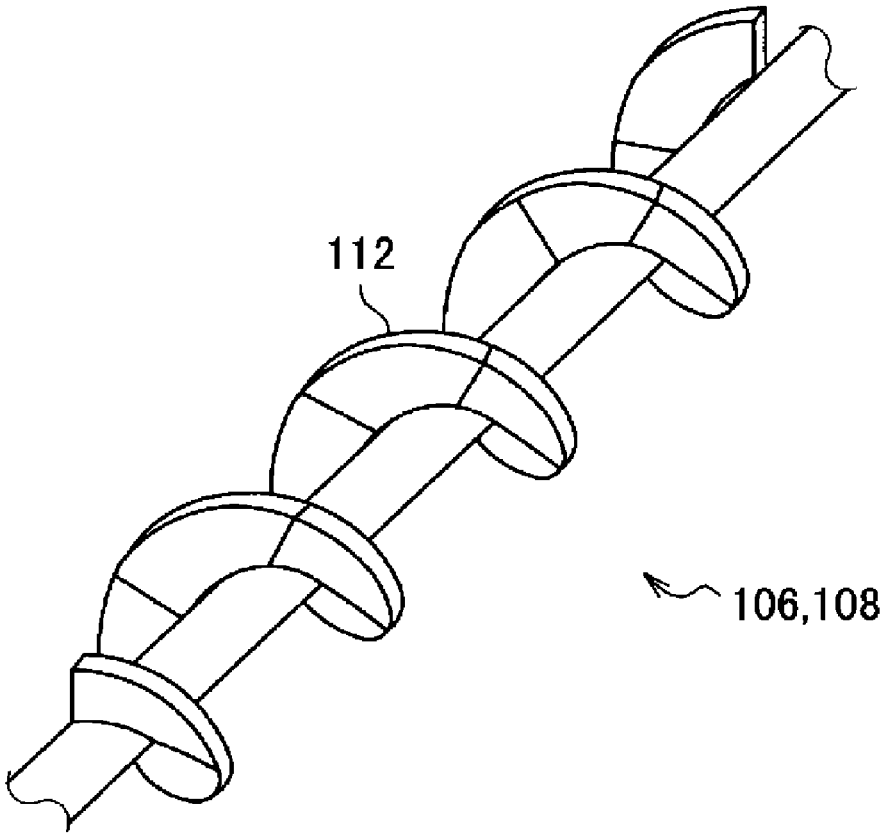
FIG. 4 is a perspective view of a first rotation member and a second rotation member of the developing apparatus of FIG. 1.

A mixing and transfer member 112 having an approximately spiral wing shape to mix and transfer the developer can be formed on a rotation shaft of the developer supply member 106 approximately parallel to the axial direction of the developing roller 104. Also, while the detailed measurements of the mixing and transfer member 112 will be described later, FIG. 4 illustrates an exemplary schematic outer appearance of the first rotation member 106 having the mixing and transfer member 112. Also, a rotation shaft of the first rotation member 106 can be rotatably supported on the developer mixing container 102 with a bearing portion 114 interposed between the first rotation member 106 and the developer mixing container 102. In the example of FIG. 3, the first rotation member 106 can rotate counterclockwise in a direction along an arrow in FIG. 3 to mix the developer, thereby transferring the developer in a downward direction on FIG. 3. Also, a circulation auxiliary member 116 having a spiral wing shape to circulate the developer in the opposite direction to the developer transfer direction can be formed on the rotation shaft of the first rotation member 106 at the downstream side in a developer transfer direction. Since the circulation auxiliary member 116 can circulate the developer moving toward the bearing portion 114 back to the center portion of the rotation shaft of the first rotation member 106, the developing apparatus 100 of the example embodiments may prevent intrusion of the developer into the bearing portion 114.

The developer mixing and transfer member 108 (hereinafter, referred to as the second rotation member 108) can be installed in the developer mixing container 102 parallel to the first rotation member 106. The mixing and transfer member 112 having an approximately spiral wing shape to mix and transfer the developer can be formed on a rotation shaft of the mixing and transfer member 112. The measurements of the mixing and transfer member 112 of a spiral wing shape will be described later. FIG. 4 illustrates an exemplary schematic outer appearance of the second rotation member 108 having the mixing and transfer member 112.

Also, the rotation shaft of the second rotation member 108 can be rotatably supported on the developer mixing container 102 with the bearing unit 114 interposed between the second rotation member 108 and the developer mixing container 102. The mixing and transfer member 112 of the second rotation member 108 can be formed to transfer the developer in the opposite direction to the developer transfer direction of the first rotation member 106. That is, as illustrated in FIG. 3, the second rotation member 108 can rotate counterclockwise in a direction indicated by an arrow of FIG. 3 so that the developer may be mixed and transferred to the upstream side of FIG. 3. Also, the circulation auxiliary member 116 having a spiral wing shape to circulate the developer in the opposite direction to the developer transfer direction can be formed on the rotation shaft of the second rotation member 108 at the downstream side in the developer transfer direction.

A center partition wall 120 sectioning the first and second rotation members 106 and 108 can be formed in the developer mixing container 102 as illustrated in FIG. 3. Accordingly, the inner space of the developer mixing container 102 can be divided by the center partition wall 120 into a first transfer portion 122, in which the developer is transferred by the first rotation member 106, and a second transfer portion 126, in which the developer is transferred by the second rotation member 108.

As illustrated in FIG. 3, an end portion partition wall 118 extending from an inner wall of the developer mixing container 102 corresponding to a position of the circulation auxiliary member 116 can be formed at both end portions of the first and second rotation members 106 and 108. The end portion partition wall 118 and the center partial wall 120 can be separated from each other as illustrated in FIG. 3. That is, a first connection portion 124 in which the developer is transferred from the first transfer portion 122 to the second transfer portion 126 can be formed between the end portion partition wall 118 at the downstream side of the first transfer portion 122 and the center partition wall 120. Also, a second connection portion 128 in which the developer is transferred from the second transfer portion 126 to the first transfer portion 122 can be formed between the end portion partition wall 118 at the downstream side of the second transfer portion 126 and the center partition wall 120. As a result, the developer can be transferred back to the first transfer portion 122 by sequentially passing through the first transfer portion 122, the first connection portion 124, the second transfer portion 126, and the second connection portion 128.

The mixing and transfer members 112 of the first and second rotation members 106 and 108 can extend farther than the center portion of each connection portion toward the downstream side in the developer transfer direction. Accordingly, since the developer can be transferred to the downstream side of each of the first and second connection portions 124 and 128, the developer may be supplied by the first rotation member 106 to both end portions of the developing roller 104.

In the developing apparatus 100, since the circulation auxiliary member 116 can be formed at the end portions of the first and second rotation members 106 and 108, the intrusion of the developer into the bearing portion 114 may be prevented. Also, since the end portion partition wall 118 can be formed at a position of the circulation auxiliary member 116, durability and reliability of the bearing portion 114 may be further improved. Also, since the mixing and transfer members 112 of the first and second rotation members 106 and 108 can extend to the downstream side in the developer transfer direction farther than the center portion of each of the first and second connection portions 124 and 128, the developer may be supplied over the whole axial direction of the developing roller 104 without increasing the size of the apparatus itself.

Also, as illustrated in FIG. 3, a toner supply portion 132 can be formed in the developer mixing container 102 at the end portion of the second rotation member 108 that is the upstream side of the developer transfer direction. Accordingly, the toner can be added to the flow of the developer along the developer circulation path. According to the above structure, the toner having a lower specific gravity than that of the carrier may be added to the flow of the developer along the developer circulation path so that a mixing performance of the toner and the carrier may be improved. However, those skilled in the art will appreciate that the position of the toner supply portion 132 is not limited to the above position illustrated in FIG. 3.

Figure 5A:
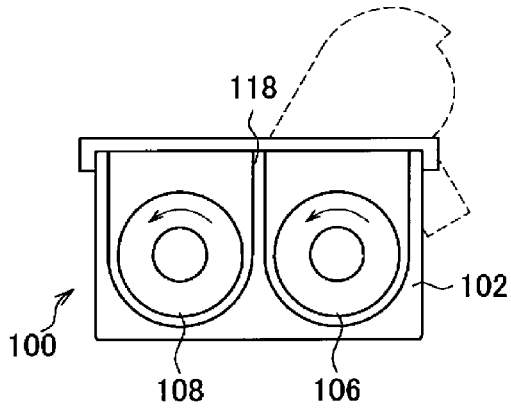
FIGS. 5A-5F are cross sectional views of the developing apparatus of FIG. 1.
Figure 5B:
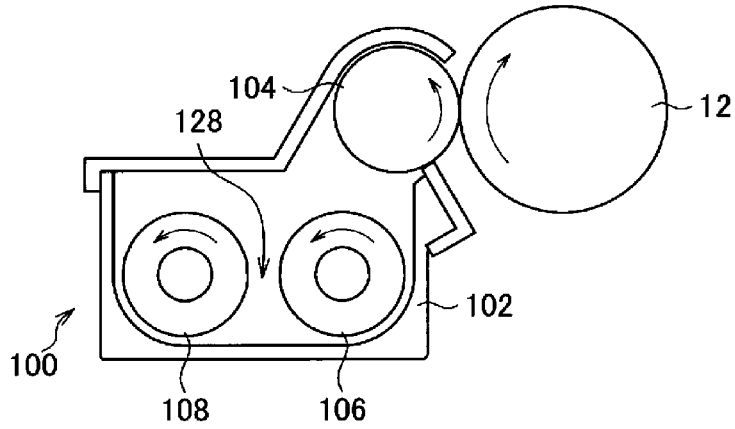
Figure 5C:
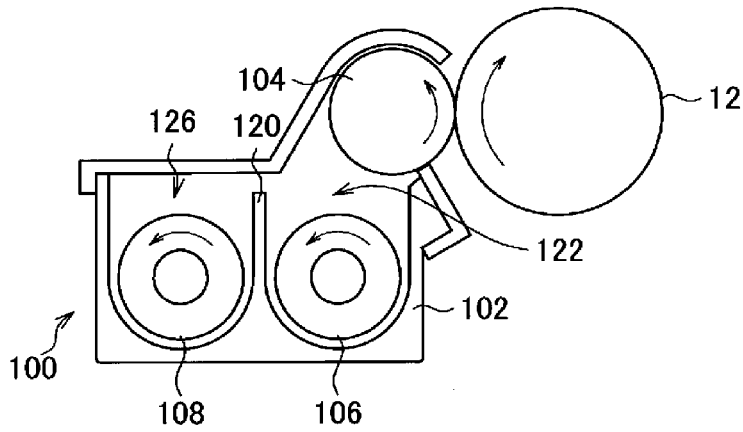
Figure 5D:
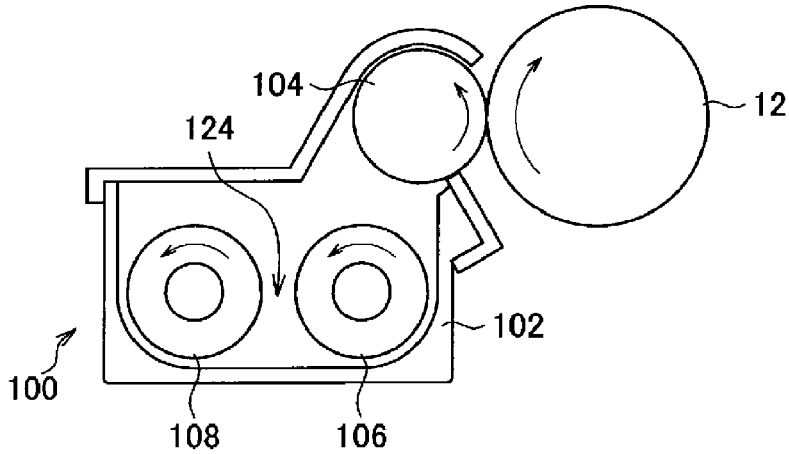
Figure 5E:
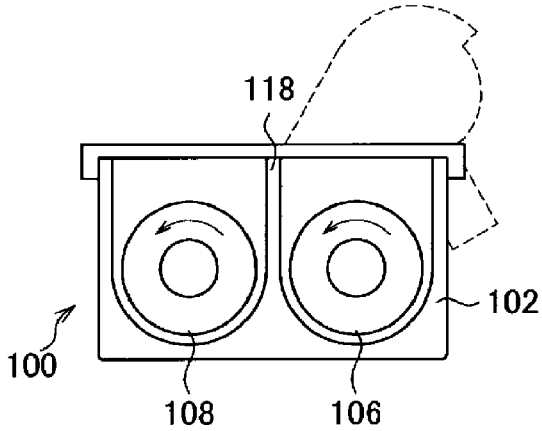
Figure 5F:
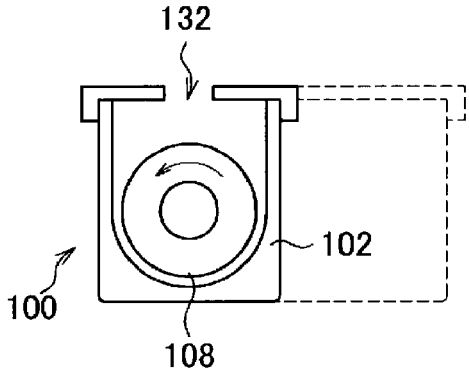

The structure of the developing apparatus 100 configured as above is described with reference to FIGS. 5A-5F. FIG. 5A is a cross sectional view of the developing apparatus 100 taken along line A-A of FIG. 3. FIG. 5B is a cross sectional view of the developing apparatus 100 taken along line B-B of FIG. 3. FIG. 5C is a cross sectional view of the developing apparatus 100 taken along line C-C of FIG. 3. FIG. 5D is a cross sectional view of the developing apparatus 100 taken along line D-D of FIG. 3. FIG. 5E is a cross sectional view of the developing apparatus 100 taken along line E-E of FIG. 3. FIG. 5F is a cross sectional view of the developing apparatus 100 taken along line F-F of FIG. 3.

Referring to FIG. 5A, the end portion partition wall 118 can be formed between the first and second rotation members 106 and 108. In the developing apparatus 100 according to the example embodiment, the end portion partition wall 118 may prevent the intrusion of the developer into the bearing portion 114 in a direction perpendicular to the axial direction Referring to FIG. 5B, no partition wall is formed between the first and second rotation members 106 and 108. Accordingly, the developer can be transferred from the second rotation member 108 to the first rotation member 106 via the second connection portion 128.

Referring to FIG. 5C, the center partition wall 120 can be formed between the first and second rotation members 106 and 108. Accordingly, the first and second transfer portions 122 and 126, which make the developer circulation path, can be formed by the center partition wall 120.

Referring to FIG. 5D, no partition wall is formed between the first and second rotation members 106 and 108, as in FIG. 5B. Accordingly, the developer can be transferred from the first rotation member 106 to the second rotation member 108 via the first connection portion 124.

Referring to FIG. 5E, the end portion partition wall 118 can be formed between the first and second rotation members 106 and 108, as in FIG. 5A. In the developing apparatus 100 according to the present embodiment, the end portion partition wall 118 may prevent the intrusion of the developer into the bearing portion 114 in a cross direction.

Referring to FIG. 5F, the toner supply portion 132 can be formed in the developer mixing container 102 above the second rotation member 108. Accordingly, the toner can be supplied to the developer mixing container 102 via the toner supply portion 132.

As described above, the developing apparatus 100 according to the present general inventive concept can include the circulation auxiliary member 116 to move the toner back to the center portion of the rotation shaft of each of the first and second rotation members 106 and 108 from the end portion of each rotation shaft that is at the downstream in the developer transfer direction. Accordingly, the developing apparatus 100 of the present embodiment may prevent the developer from intruding into the bearing portion 114 by deviating from the developer circulation path, and also may maintain durability of the bearing portion 114.

The developing apparatus 100 of the present embodiment can include the end partition wall 118 between both end portions of the first and second rotation members 106 and 108 so that the developer may be prevented from intruding into the bearing portions 114 of the first and second rotation members 106 and 108 from a direction perpendicular to the axial direction.

Also, in the developing apparatus 100 of the present embodiment, the mixing and transfer members 112 of the first and second rotation members 106 and 108 extend to the downstream side in the developer transfer direction farther than the center portion of each of the first and second connection portions 124 and 128. As a result, since the developer is transferred to the downstream side of each of the first and second connection portions 124 and 128, the developer may be supplied over the whole axial direction of the developing roller 104 without increasing the size of the apparatus.

As a result, the developing apparatus 100 of the present general inventive concept may maintain durability of the bearing portion 114 and can simultaneously supply the developer over the whole axial direction of the developing roller 104 without increasing the size of the apparatus.

A detailed design example of an exemplary developing apparatus 100 having the above features will be described by indicating the appropriate shapes and dimension of each constituent element. However, the present general inventive concept is not limited to any of the particular shapes and dimensions which are described herein for purposes of illustration and description only. Also, the following shapes and dimensions described herein may be appropriate to implement the developing apparatus 100 according to example embodiments of the present general inventive concept, but the present general inventive concept is not limited thereto. To the contrary, the shape of each drawing referred to in the following description is merely a conceptual drawing to describe exemplary shapes and dimensions and dimension ratios, which may be different from actual dimension ratios.

Figure 6:
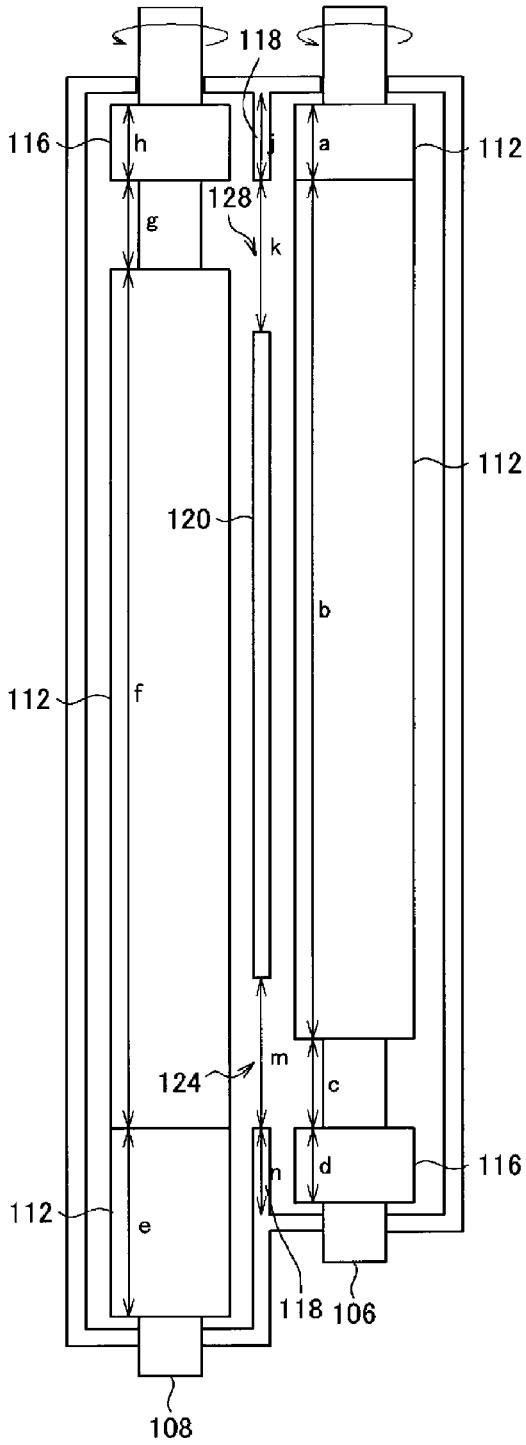
FIGS. 6-8 illustrate appropriate shapes and dimensions of the developing apparatus of FIG. 1.
Figure 7:
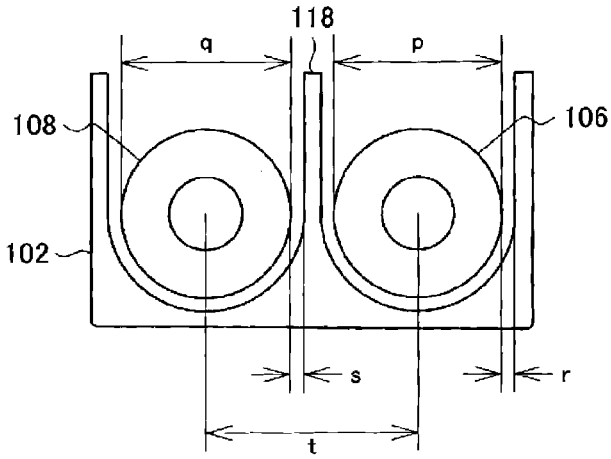

FIG. 6 illustrates the dimension of each rotation member of each constituent portion in a lengthwise direction and the spiral pitches of the mixing and transfer member 112 and the circulation auxiliary member 116 in the developing apparatus 100. Also, FIG. 7 is a cross sectional view of the developing apparatus 100, which corresponds to FIG. 5A. By being designed with the shapes and dimensions as illustrated in FIGS. 6 and 7, the developing apparatus 100 may be provided without increasing the size of the apparatus itself.

For example, to improve a developer transfer efficiency by the circulation auxiliary member 116, the spiral pitch can be increased or the length of a section where the circulation auxiliary member 116 is formed can be increased. However, to prevent the increase in the size of the developing apparatus 100, the circulation auxiliary member 116 can be designed with the minimum dimensions in a range of preventing the intrusion of developer into the bearing portion 114. In detail, the spiral pitch of the circulation auxiliary member 116 can be set to be about ¼-½ of the outer diameter of the circulation auxiliary member 116. As illustrated in FIG. 7, since the outer diameter of the circulation auxiliary member 116 is 18 mm, the spiral pitch of the circulation auxiliary member 116 can be set to be about 4.5 mm-9 mm, and 5 mm, in accordance with the design example as illustrated in FIG. 6 (see "d" and "h" of FIG. 6).

The mixing and transfer member 112 can be formed at the end portion of the first rotation member 106 at the upstream side of the developer transfer direction may be designed in the same conditions as those of the circulation auxiliary member 116. That is, the spiral pitch of the mixing and transfer member 112 at the end portion of the first rotation member 106 may be smaller than the spiral pitch (25 mm) of the mixing and transfer member 112 at the center portion and equal to the spiral pitch (5 mm) of the circulation auxiliary member 116 (see "a" of FIG. 6).

Also, the length of the section where the circulation auxiliary member 116 is formed can be set to be about 1.5-3 times of the spiral pitch of the circulation auxiliary member 116, for example, 2-2.5 times. Accordingly, the increase in the size of the developing apparatus itself due to the formation of the circulation auxiliary member 116 may be prevented. In the example embodiment, since the spiral pitch of the circulation auxiliary member 116 is 5 mm, the length of the section where the circulation auxiliary member 116 is set to be 10 mm (see "d" and "h" of FIG. 6).

Also, the end portion partition wall 118 can be formed by extending from the inner wall of the developer mixing container 102 as long as the length of the section where the circulation auxiliary member 116 is formed to which a length of 0.5-1 mm is added. This is in consideration of the shape of the circulation auxiliary member 116 in the axial direction. In the present design example, since the length of the section where the circulation auxiliary member 116 is formed is 10 mm, the end portion partition wall 118 extends by about 11 mm from the inner wall of the developer mixing container 102 (see "j" and "n" of FIG. 6). Thus, a space needed for an end portion of each rotation member may be minimized.

Also, the circulation auxiliary member 116 and the mixing transfer member 112 can be separated from each other by about 1-2 times of the spiral pitch of the circulation auxiliary member 116. In the present design example, since the spiral pitch of the circulation auxiliary member 116 is 5 mm, the circulation auxiliary member 116 can be separated from the mixing transfer member 112 by about 8 mm (see "c" and "g" of FIG. 6).

Also, the length of an interval section ("k" of FIG. 6) between the center partition wall 120 and the end portion partition wall 118, forming the second connection portion 128, can be set to be about 1-1.5 times of the spiral pitch of the mixing and transfer member 112 of the first rotation member 106 at the center portion thereof. Likewise, the length of an interval section ("m" of FIG. 6) between the center partition wall 120 and the end portion partition wall 118, forming the first connection portion 124, can be set to be about 1-1.5 times of the spiral pitch of the mixing and transfer member 112 of the second rotation member 108 at the center portion thereof. In the present design example, since the spiral pitches of both of the first and second rotation members 106 and 108 at the center portion thereof are 25 mm, the length of the section where each of the first and second connection portions 124 and 128 is formed can be about 30 mm. Also, as described above, the mixing and transfer member 112 can extend to the downstream in the developer transfer direction with respect to the center portion of corresponding connection portions. That is, the sections "c" and "g" in FIG. 6 can be located at the downstream sides in the developer transfer direction with respect to the center portion of the section where each of the first and second connection portions 124 and 128 is formed. As a result, the developer may be supplied to the end portion of the developing roller 104 by the first rotation member 106.

Also, to efficiently transfer the developer, clearance between each rotation member and the developer mixing container 102 can be decreased and further the vibration of the rotation member needs to be considered. In the present design example, the clearance between each rotation member and the developer mixing container 102 can be set to be 1.5 mm as illustrated in FIG. 7.

Figure 8:
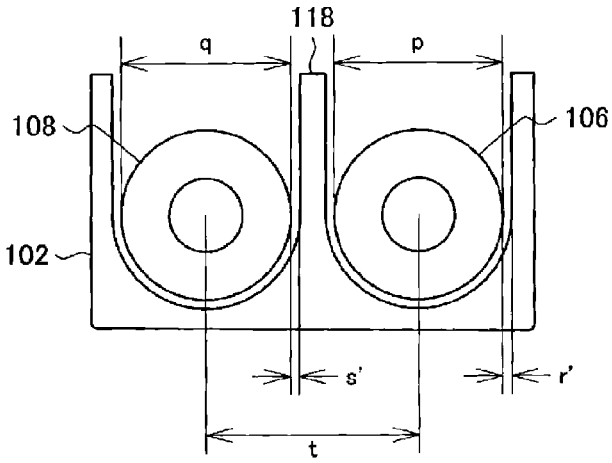

To further prevent the intrusion of the developer into the bearing portion 114, the clearance may be set to values indicated in FIG. 8 in consideration that the vibration of the rotation member is smaller at the end portion than the center portion. Referring to FIG. 8, the clearance between the end portion of each rotation member and the developer mixing container 102 can be set to about 1.0 mm which is smaller than the clearance of 1.5 mm at the center portion. For example, the clearance may be realized by changing the thickness of the developer mixing container 102 or the end portion partition wall 118. As a result, the developer may be more efficiently moved back to the center portion of the rotation shaft by the circulation auxiliary member 116 so that the bearing portion 114 may be further protected.

Figure 9:
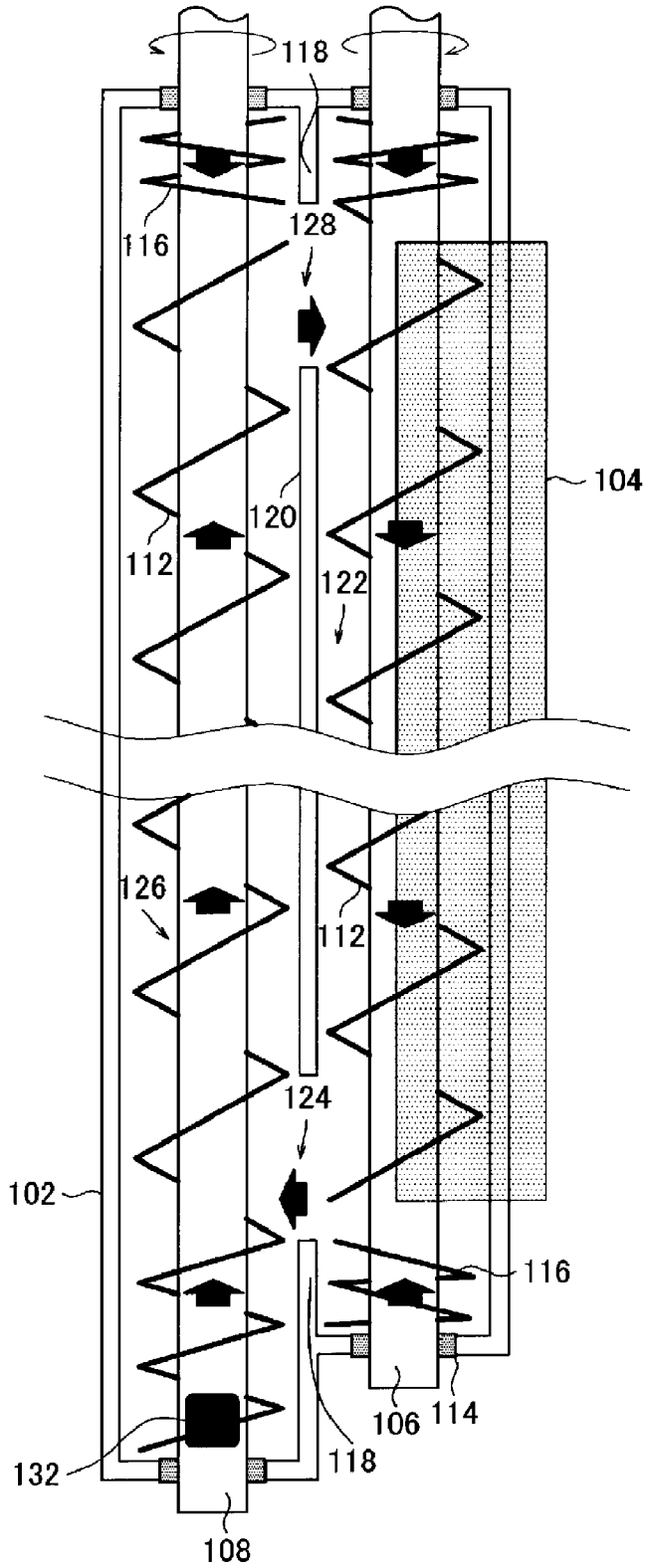
FIG. 9 illustrates the structure of a developing apparatus according to another embodiment of the present general inventive concept.

By designing the developing apparatus 100 with the above dimensions, the above-described features of the developing apparatus 100 may be efficiently implemented without increasing the size of the developing apparatus 100. Also, as described above, the developing apparatus 100 of the example embodiments may be applied to a variety of types of image forming apparatuses and the above-described features may be obtained by appropriately changing the design of the image forming apparatus. For example, the developing apparatus 100 included in the paper vertical transfer type image forming apparatus 10' of FIG. 2 may be configured as illustrated in FIG. 9. FIG. 9 illustrates the structure of the developing apparatus 100 included in the paper vertical transfer type image forming apparatus 10' of FIG. 2.

In the image forming apparatus 10', as illustrated in FIG. 2, the rotation direction of the developing roller 104 can be opposite to that of the tandem type image forming apparatus 10 of FIG. 1. Thus, when the developer circulation path in the developer mixing container 102 is the same direction as that in the above example illustrated in FIG. 3, as illustrated in FIG. 9, the first rotation member 106 can rotate in the opposite direction to that of the above example, that is, the direction indicated by the arrow of FIG. 9. The spiral winding directions of the mixing and transfer member 112 and the circulation auxiliary member 116 formed on the first rotation member 106 can be the opposite to that of the example embodiment. Accordingly, the rotation direction of each rotation member, the spiral winding directions of the mixing and transfer member 112 and the circulation auxiliary member 116, or the developer circulation direction may be changed according to the design specification of the developing apparatus 100.

As described above, according to the present general inventive concept, durability of the bearing portion can be maintained and a developer can be simultaneously supplied to the overall surface of a developing roller (or a developer holding member) in the axial direction of the developing roller, without increasing the size of the developing apparatus.

While the present general inventive concept has been particularly illustrated and described with reference to exemplary embodiments thereof, it will be understood by those skilled in the art that various changes in form and details may be made therein without departing from the spirit and scope of the general inventive concept as defined by the appended claims.

For example, in the above-described embodiment, the shapes and dimensions may be described with respect to the design example of the developing apparatus 100, but the present general inventive concept is not limited to the above-described shapes and dimensions. For example, the rotation direction of each rotation member or the spiral winding directions of the mixing and transfer member 112 and the circulation auxiliary member 116 may be changed according to the design specification such as the type of an image forming apparatus or the developer circulation path.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing apparatus including a developer mixing container in which a developer circulation path along which developer including toner and carrier are mixed and circulated is formed, and a developer holding member to hold the developer mixed on the developer circulation path, the developer mixing container comprising:

a first rotation member to supply the developer to the developer holding member and comprising a rotation shaft extending in the same direction as a rotation shaft direction of the developer holding member, a mixing and transfer member having a spiral wing shape on a corresponding rotation shaft to mix and transfer the developer to any one of a lengthwise direction of the rotation shaft, and a circulation auxiliary member having a spiral wing shape formed in a section on a corresponding rotation shaft to transfer the developer to a center portion of the rotation shaft from a downstream side in a developer transfer direction;

a second rotation member comprising a rotation shaft extending in the same direction as a rotation shaft direction of the first rotation member and parallel to the first rotation member, a mixing and transfer member having a spiral wing shape on a corresponding rotation shaft to transfer the developer in a direction opposite to the developer transfer direction by the first rotation member, and a circulation auxiliary member having a spiral wing shape formed in a section on a corresponding rotation shaft to transfer the developer to a center portion of the rotation shaft from a downstream side in the developer transfer direction;

two end portion partition walls extending from an inner wall of the developer mixing container along the circulation auxiliary member between the first and second rotation members; and a center partition wall formed in a section along the mixing and transfer member at a position separated from the end portion partitions wall between the first and second rotation members, wherein a spiral pitch of the circulation auxiliary member is in a range of about ¼-½ of an outer diameter of the circulation auxiliary member, wherein a section in which the circulation auxiliary member is formed is in a range of about 1.5-3 of the spiral pitch of the circulation auxiliary member, wherein a connection portion through which the developer is circulated is formed as the end portion partition walls and the center partition wall are separated from each other by about 1-1.5 times of the spiral pitch of the mixing and transfer member, and wherein the mixing and transfer member formed on each of the first and second rotation members extends to the downstream side in the developer transfer direction farther than at least a center portion of each of the first and second connection portions.

2. The developing apparatus of claim 1, wherein clearance between the developer mixing container and each of the first and second rotation members at positions where the end portion partition walls are formed is smaller than that between the developer mixing container and each of the first and second rotation members at positions where the center partition wall is formed.

3. The developing apparatus of claim 1, wherein the circulation auxiliary member is separated from the mixing and transfer member by about 1-2 times of the spiral pitch of the circulation auxiliary member.

4. The developing apparatus of claim 1, wherein the section where the circulation auxiliary member is formed is about 2-2.5 times of the spiral pitch of the circulation auxiliary member.

5. An imaging unit comprising:

an image holding member in which an electrostatic latent image is formed on a circumferential surface thereof;

a developing apparatus to adhere toner to the electrostatic latent image formed on the circumferential surface of the image holding member; and a cleaning apparatus to remove the toner remaining on the circumferential surface of the image holding member, wherein the developing apparatus includes a developer mixing container in which a developer circulation path along which developer including toner and carrier are mixed and circulated is formed, and a developer holding member to hold the developer mixed on the developer circulation path, the developer mixing container comprising:

a first rotation member rotatably coupled to a first bearing portion at a first end of the mixing container and to a second bearing portion at a second end of the mixing container and having a first mixing and transfer member to circulate developer in a first direction from the first bearing portion to the second bearing portion and a first auxiliary member proximate the second bearing portion to circulate the developer away from the second bearing portion in a second direction opposite the first direction, the first auxiliary member including a spiral member formed on a portion of the first rotation member and having a pitch of about ¼-½ of an outer diameter of the first auxiliary member; and a second rotation member rotatably coupled to a third bearing portion at the first end of the mixing container and to a fourth bearing portion at the second end of the mixing container and having a second mixing and transfer member to circulate developer in the second direction and a second auxiliary member proximate the third bearing portion to circulate developer away from the third bearing portion in the first direction.

6. The imaging unit of claim 5, wherein the developer mixing container further comprises:

two end portion partition walls extending from an inner wall of the developer mixing container between the first and second rotation members; and a center partition wall formed in a section along the mixing and transfer members at a position separated from the end portion partition walls between the first and second rotation members to define first and second openings between the first and second rotation members.

7. The imaging unit of claim 6, wherein the mixing and transfer members formed on each of the first and second rotation members extend along the first and second rotation members beyond at least a center portion of the first and second openings.

8. An image forming apparatus including a detachable imaging unit to form an image on a recording medium, wherein the image unit comprises:

an image holding member in which an electrostatic latent image is formed on a circumferential surface thereof;

a developing apparatus to adhere toner to the electrostatic latent image formed on the circumferential surface of the image holding member; and a cleaning apparatus to remove the toner remaining on the circumferential surface of the image holding member, wherein the developing apparatus includes a developer mixing container in which a developer circulation path along which developer including toner and carrier are mixed and circulated is formed, and a developer holding member to hold the developer mixed on the developer circulation path, the developer mixing container comprising:

a first rotation member rotatably coupled to a first bearing portion at a first end of the mixing container and to a second bearing portion at a second end of the mixing container and having a first mixing and transfer member to circulate developer in a first direction from the first bearing portion to the second bearing portion and a first auxiliary member proximate the second bearing portion to circulate the developer away from the second bearing portion in a second direction opposite the first direction, the first auxiliary member including a spiral member formed on a portion of the first rotation member and having a pitch of about ¼-½ of an outer diameter of the first auxiliary member;

a second rotation member rotatably coupled to a third bearing portion at the first end of the mixing container and to a fourth bearing portion at the second end of the mixing container and having a second mixing and transfer member to circulate developer in the second direction and a second auxiliary member proximate the third bearing portion to circulate developer away from the third bearing portion in the first direction.

9. The image forming apparatus of claim 8, wherein the developer mixing container further comprises:

two end portion partition walls extending from an inner wall of the developer mixing container between the first and second rotation members; and a center partition wall formed in a section along the mixing and transfer members at a position separated from the end portion partition walls between the first and second rotation members to define first and second openings between the first and second rotation members.

10. The image forming apparatus of claim 9, wherein the mixing and transfer members formed on each of the first and second rotation members extend along the first and second rotation members beyond at least a center portion of the first and second openings.

11. A mixing container to mix developer of an image forming unit, comprising:

a first rotation member rotatably coupled to a first bearing portion at a first end of the mixing container and to a second bearing portion at a second end of the mixing container to circulate developer in a first direction from the first bearing portion to the second bearing portion; and a first auxiliary member coupled to the first rotation member proximate the second bearing portion to circulate the developer away from the second bearing portion in a second direction opposite the first direction, the first auxiliary member including a spiral member formed on a portion of the first rotation member and having a pitch of about ¼-½ of an outer diameter of the first auxiliary member.

12. The mixing container of claim 11, further comprising:

a second rotation member rotatably coupled to a third bearing portion at the first end of the mixing container and to a fourth bearing portion at the second end of the mixing container to circulate developer in the second direction; and a second auxiliary member coupled to the second rotation member proximate the third bearing portion to circulate developer away from the third bearing portion in the first direction.

13. The mixing container of claim 12, further comprising:

a partition wall disposed between the first and second rotation members to define first and second circulation portions of the mixing container, respectively, and having a first opening proximate the first and third bearing portions and a second opening proximate the second and fourth bearing portions to communicate the developer between the first and second circulation portions.

14. The mixing container of claim 13, further comprising:

a supply portion to supply developer to the second circulation portion; and a developing roller mounted adjacent the first rotation member and between the first and second auxiliary members to receive the developer from the first circulation portion.

15. An image forming apparatus having a developing device to form an image on a recording medium, the developing device comprising:

a mixing container to supply developer to the developing device;

a first rotation member rotatably coupled to a first bearing portion at a first end of the mixing container and to a second bearing portion at a second end of the mixing container to circulate developer in a first direction from the first bearing portion to the second bearing portion; and a first auxiliary member coupled to the first rotation member proximate the second bearing portion to circulate the developer away from the second bearing portion in a second direction opposite the first direction, the first auxiliary member including a spiral member formed on a portion of the first rotation member and having a pitch of about ¼-½ of an outer diameter of the first auxiliary member.

16. The image forming apparatus of claim 15, wherein the mixing container further comprises:

a second rotation member rotatably coupled to a third bearing portion at the first end of the mixing container and to a fourth bearing portion at the second end of the mixing container to circulate developer in the second direction; and a second auxiliary member coupled to the second rotation member proximate the third bearing portion to circulate developer away from the third bearing portion in the first direction.

17. The image forming apparatus of claim 16, wherein the mixing container further comprises:

a partition wall disposed between the first and second rotation members to define first and second circulation portions of the mixing container, respectively, and having a first opening proximate the first and third bearing portions and a second opening proximate the second and fourth bearing portions to communicate the developer between the first and second circulation portions.

18. The image forming apparatus of claim 17, wherein the mixing container further comprises:

a supply portion to supply developer to the second circulation portion; and a developing roller mounted adjacent the first rotation member and between the first and second auxiliary members to receive the developer from the first circulation portion.

* * * * *